US009278239B2

(12) United States Patent
Pigeon

(10) Patent No.: US 9,278,239 B2
(45) Date of Patent: Mar. 8, 2016

(54) FIRE SPRINKLER SYSTEM AND METHOD OF INSTALLATION

(71) Applicant: Jeffrey Pigeon, Ann Arbor, MI (US)

(72) Inventor: Jeffrey Pigeon, Ann Arbor, MI (US)

(73) Assignee: Firebird Sprinkler Company, LLC, Ann Arbor, MI (US)

( * ) Notice: Subject to any disclaimer, the term of this patent is extended or adjusted under 35 U.S.C. 154(b) by 210 days.

(21) Appl. No.: 14/253,134

(22) Filed: Apr. 15, 2014

(65) Prior Publication Data

US 2014/0216765 A1 Aug. 7, 2014

Related U.S. Application Data

(63) Continuation of application No. 12/109,217, filed on Apr. 24, 2008, now Pat. No. 8,733,461, which is a continuation of application No. PCT/US2006/025111, filed on Jun. 27, 2006.

(51) Int. Cl.
*A62C 35/68* (2006.01)
*A62C 35/58* (2006.01)

(52) U.S. Cl.
CPC ..... *A62C 35/68* (2013.01); *A62C 35/58* (2013.01); *Y10T 29/53* (2015.01)

(58) Field of Classification Search
CPC ..... A62C 35/68; A62C 35/58; Y10T 29/53
USPC ..... 169/5, 16, 17, 37, 54, 58, 41, 57; 239/499, 500, 518, 523, 524, DIG. 1
See application file for complete search history.

(56) References Cited

U.S. PATENT DOCUMENTS 4,585,069 A * 4/1986 Whitaker ..... B05B 1/262 169/37

* cited by examiner

*Primary Examiner* — Justin Jonaitis
(74) *Attorney, Agent, or Firm* — Endurance Law Group, PLC

(57) ABSTRACT

The fire sprinkler system of the preferred embodiments is preferably installed in a space defined by two beams, such as rafters, extending along the width of a space and separated by a distance equal to a length of the space. The fire sprinkler system includes a supply line generally extending along the width of the space and generally located between the rafters, and a series of sprinklers connected to the supply line. Each sprinkler is adapted to disperse in a coverage area having a length and a width, which is substantially less than the length. Each sprinkler is oriented such that the length of each coverage area extends in opposite directions toward the rafters. The fire sprinkler system may also be installed in a space having a series of purlins extending the length of the space. In this variation, each sprinkler is located between two purlins.

12 Claims, 3 Drawing Sheets

FIRE SPRINKLER SYSTEM AND METHOD OF INSTALLATION

CROSS-REFERENCE TO RELATED APPLICATIONS

This application is a continuation of U.S. patent application Ser. No. 12/109,217, filed 24 Apr. 2008, which is a continuation of International Patent Application number PCT/US2006/025111, filed on 27 Jun. 2006, both of which are incorporated in their entirety by this reference.

This application is related to international patent application number PCT/US2006/025278, filed on 27 Jun. 2006, which is incorporated in its entirety by this reference.

TECHNICAL FIELD

This invention relates generally to the fire suppression and extinguishment field, and more specifically to a new and improved sprinkler system and method of installation in the fire suppression and extinguishment field.

BACKGROUND

Fire sprinkler systems have been used in the United States to protect warehouses and factories for over one hundred years. Fire sprinkler systems are positioned near the ceiling of a room where hot "ceiling jets" spread radially outward from a fire plume. When the temperature at an individual sprinkler reaches a pre-determined value, the thermally responsive element in the sprinkler activates and permits the flow of water as a water jet through an orifice toward a deflector. The metal deflector redirects the water jet into thin streams or "ligaments" that break up into droplets due to surface tension. The water droplets serve three purposes: (1) delivering water to the burning material and reducing the combustion rate, (2) wetting the surrounding material and reducing the flame spread rate, and (3) cooling the surrounding air through evaporation and displacing air with inert water vapor.

A typical sprinkler has a coverage area of 200 $ft^2$ (18.5 $m^2$), which is typically measured in a circular pattern with a radius of 8 feet (2.5 m) or in a square pattern with equal sides of 14 feet (4.25 m). A typical metal building includes at least three beams, such as rafters, extending along the width of a space and separated from each other by a distance of 25-30 feet (7.5 m to 9 m). As shown in FIGS. 3 and 4, a conventional fire sprinkler system for a typical metal building includes four supply lines, each with four typical sprinklers.

From a labor and materials viewpoint, the installation of every individual supply line is an additional cost. An additional supply line requires additional labor, as the installers of the fire sprinkler system must fasten each supply line to a structural member near the ceiling, which typically requires the use of a ladder or a platform. An additional supply line also requires additional metal, which is the typical material for the supply lines. Thus, there is a need in the fire suppression and extinguishment field to create an improved sprinkler system and method of installation that reduces the labor and/or materials costs. This invention provides such improved sprinkler system and method of installation.

DESCRIPTION OF THE PREFERRED EMBODIMENTS

The following description of the preferred embodiments of the invention is not intended to limit the invention to these preferred embodiments, but rather to enable any person skilled in the art of fire suppression and extinguishment to make and use this invention.

Figure 1:
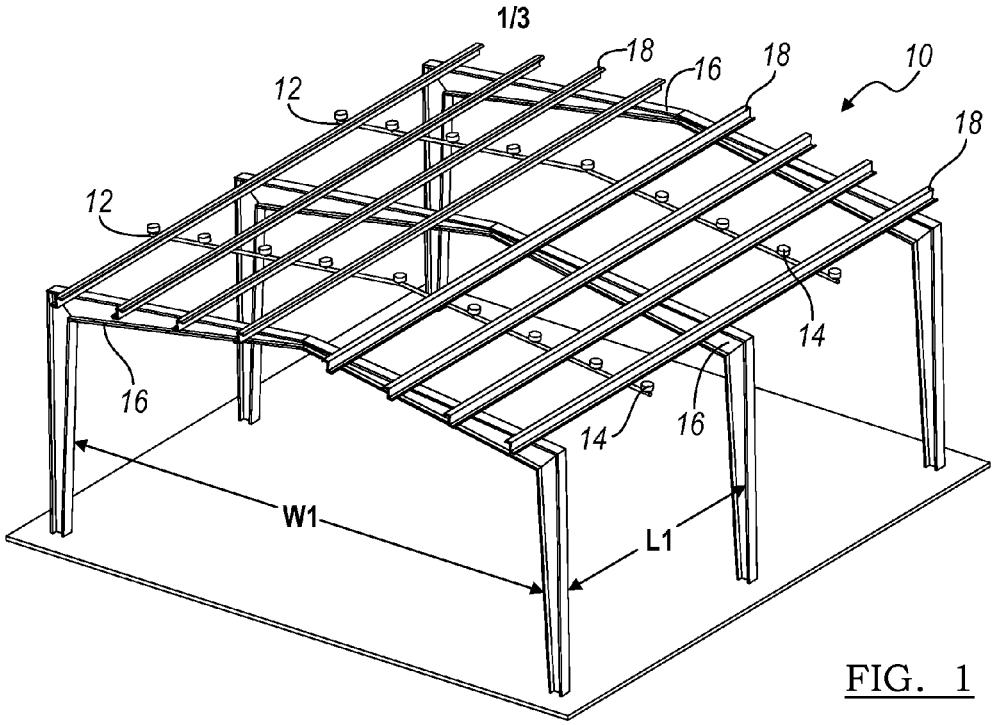
FIGS. 1 and 2 are perspective and overhead views, respectively, of a fire sprinkler system with two supply lines, each with eight new sprinklers, according to the preferred embodiments.
Figure 3:
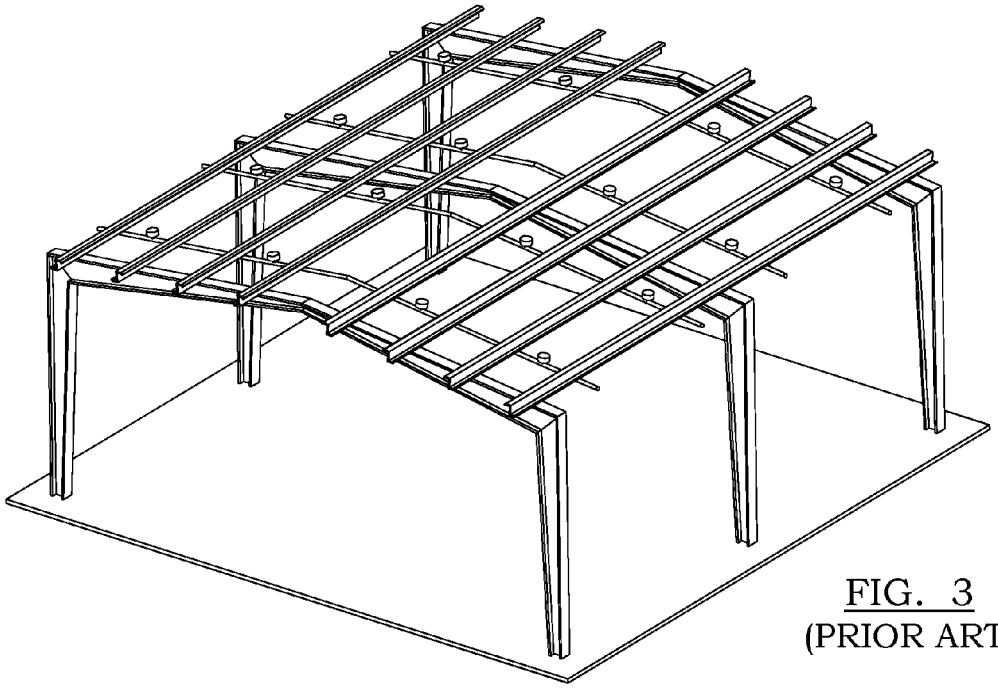
FIG. 3 (PRIOR ART)
FIGS. 3 and 4 are perspective and overhead views, respectively, of a conventional fire sprinkler system with four supply lines, each with four typical sprinklers, according to the teachings of the prior art.
Figure 2:
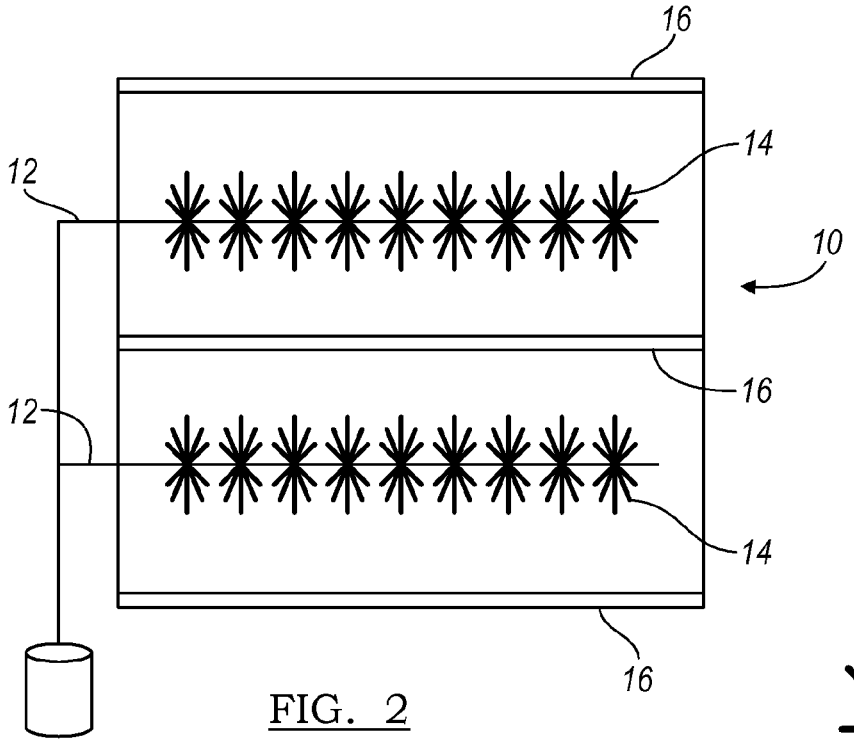

As shown in FIGS. 1 and 2, the fire sprinkler system 10 of the preferred embodiments includes a supply line 12 and a series of sprinklers 14 connected to the supply line 12. The fire sprinkler system 10 of the preferred embodiments is preferably installed in a space having a width W1 of at least 20 feet (6 m) and a length L1 of at least 20 feet (6 m), and is more preferably installed in a space having a width of at least 20 feet (6 m) and a length of approximately 25-30 feet (7.5 m to 9 m). The space is preferably defined by two beams 16 extending along the width of the space and separated by a distance equal to the length of the space. The beams 16 function to support the weight of the roof (shown in FIG. 5). The beams 16 are preferably steel I-shaped rafters 16, but the beams 16 may be any suitable structural member to transfer the weight of the roof, may be made from any suitable material, and may be shaped in any suitable manner. The height of the space is preferably 20 to 40 feet (6 to 12 m), but may alternatively be any suitable height. In a variation of the preferred embodiment, the space may include a series of purlins 18 extending the length of the space and separated by a distance of approximately 5-6 feet (1-2 m). The purlins 18, which span lengthwise between the rafters 16 and are fixed onto the rafters 16, function to support the weight of the roofing sheets (not shown) of the roof. The purlins 18 are preferably steel Z-shaped purlins 18, but the purlins 18 may be any suitable structural member to support the roofing sheets of the roof, may be made from any suitable material, and may be shaped in any suitable manner. Preferably, the fire sprinkler system 10 is installed in a metal building (such as a prefabricated metal building), but the fire sprinkler system 10 may alternatively be installed in any suitable shelter.

The supply line 12 of the preferred embodiments functions to supply a fire suppressing or extinguishing substance to the sprinklers 14. The supply line 12 preferably supplies water to the sprinklers 14, but may alternatively supply any suitable substance that suppresses or extinguishes fires. The supply line 12 preferably extends along the width W1 of the space, and is preferably located between the beams 16. More preferably, the supply line 12 generally bisects the distance between the beams 16.

Figure 5:
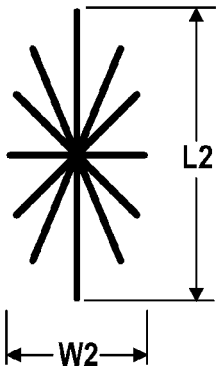
FIG. 5 is a detailed view of the coverage area of the sprinkler of the preferred embodiment.
Figure 4:
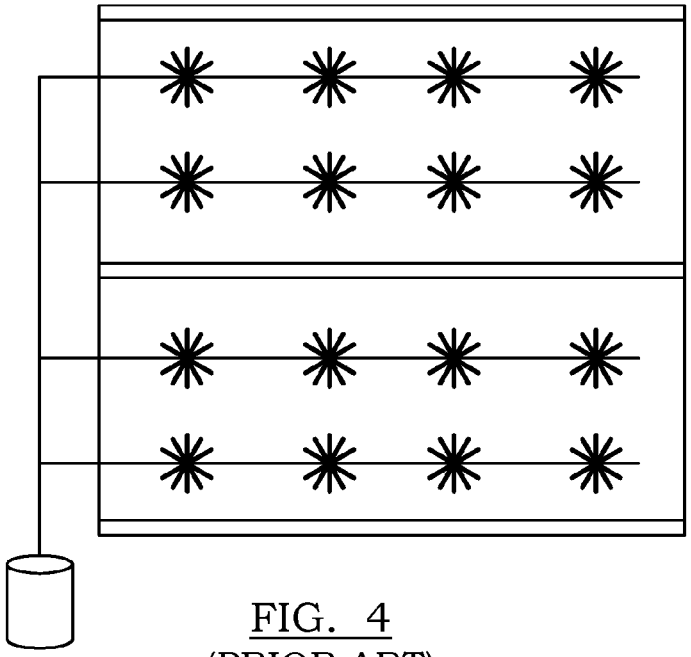
FIG. 4 (PRIOR ART)

As shown in FIGS. 2 and 5, the series of sprinklers 14 of the preferred embodiments function to disperse the fire suppressing or extinguishing substance in a coverage area having a length L2 and a width W2. Preferably, the width W2 of each coverage area is less than the length L2 of each coverage area. In a first variation, the width W2 of each coverage area is less than 66% of the length L2 of each coverage area. In a second variation, the width W2 of each coverage area is less than 33% of the length L2 of each coverage area. In a third variation, the length L2 of each coverage area is at least 20 feet (6 m) and the width W2 of each coverage area is approximately 5-6 feet (1-2 m). In a fourth variation, the length L2 of each coverage area is approximately equal to the distance between the rafters 16 of the space, and the width W2 of each coverage area is approximately equal to the distance between the purlins 18. In alternative variations, the length L2 and the width W2 of each coverage area may be any suitable dimension.

Each sprinkler 14 of the preferred embodiments is connected to the supply line 12 and located along the supply line 12 such that the coverage areas of the sprinklers 14 overlap at least a significant portion of the space. Each sprinkler 14 is preferably oriented such that the length L2 of its coverage area extends in opposite directions toward the beams 16 and the width W2 of each coverage area extends to the two closest purlins 18. Locating the supply line 12 between the rafters 16 and orienting the sprinklers 14 towards the rafters 16 allows the fire sprinkler system 10 to be installed in a typically metal building with one-half of the supply lines of a conventional fire sprinkler system, which greatly reduces the labor and materials for the fire sprinkler system 10. Although only one version is shown, the sprinkler 14 may be an upright-type sprinkler (above the supply line), a pendant-type sprinkler (below the supply line), or may alternatively be two horizontal-type sprinklers connected back-to-back.

Figure 6:
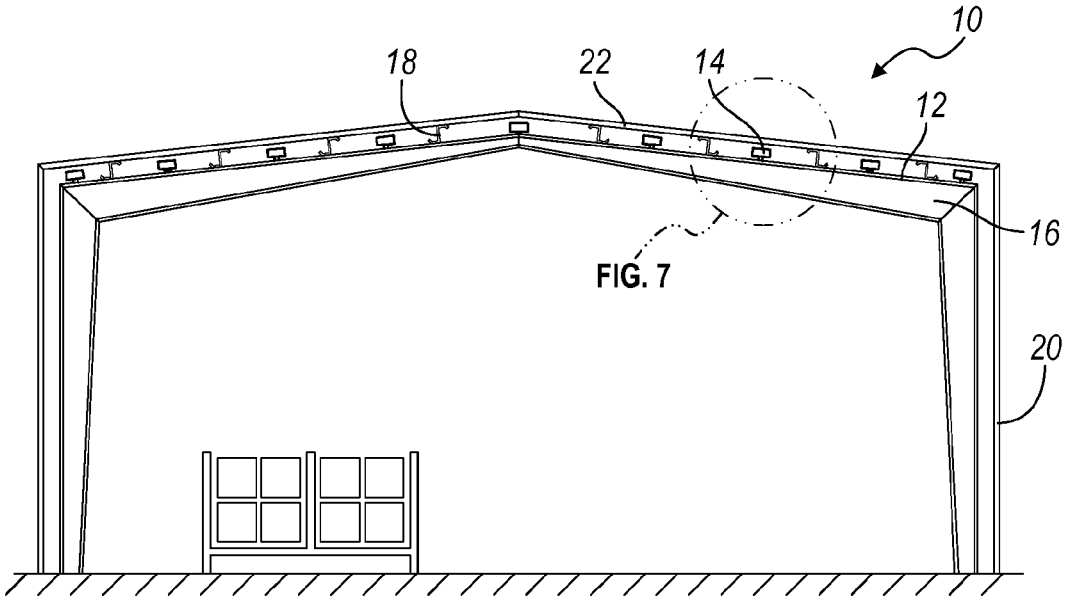
FIG. 6 is a side view of the fire sprinkling system according to a variation of the preferred embodiment in a metal building with purlins.
Figure 7:
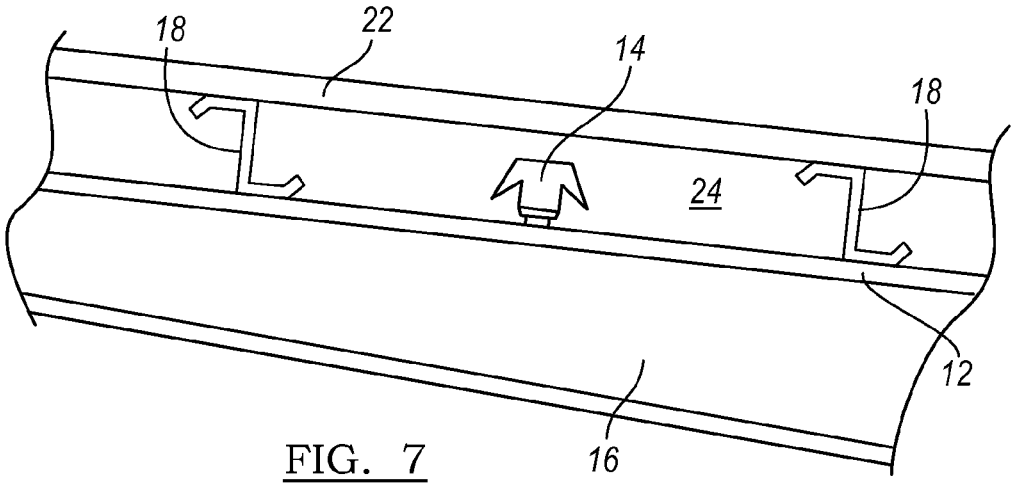
FIG. 7 is a detailed view of a portion of FIG. 6.

In a variation of the preferred embodiments, as shown in FIGS. 6 and 7, each sprinkler 14 is located along the supply line 12 between two purlins 18 such that each sprinkler 14 generally bisects the distance between either the two closest purlins 18 or the closest purlin 18 and a wall 20 or other structural member. When the sprinkler 14 is located between two rafters 16 and between two purlins 18, it is generally centered within a volume 24 defined by a vertical extension of the rafters 16 on two sides, the purlins 18 on two sides, a first horizontal extension of the top of the purlins 18 (i.e., the roof 22) on one side, and finally a second horizontal extension of the bottom of the purlins 18. The hot "ceiling jets" that spread radially outward from a fire plume generally fills this volume 24. By centering the sprinkler 14 in this volume, the fire sprinkler system 10 may be able to respond faster to the fire.

As a person skilled in the art of fire suppression and extinguishment will recognize from the previous detailed description and from the figures and claims, modifications and changes can be made to the preferred embodiments of the invention without departing from the scope of this invention defined in the following claims.

I claim:

1. A method for installing a fire sprinkler system in a structure having a roof, the roof including a generally planar roof section supported above a pair of adjacent structural support members arranged parallel to one another, said method comprising the steps of:

securing one tubular supply line in an operative position below the roof in the region between the structural support members, the supply line configured as the sole source to conduct a liquid fire suppressing substance for emergency discharge onto a fire event below the roof and the structural support members, regularly spacing a plurality of sprinklers along the supply line in fluid communication with the liquid fire suppressing substance, discharging liquid fire suppressing substance from at least one sprinkler in a non-circular spray pattern in direct response to a fire event, the non-circular spray pattern defined by a major length (L2) and a smaller minor width (W2), and arranging the sprinklers so that the minor width (W2) of each spray pattern is generally parallel to the supply line and the major length (L2) of each spray pattern is generally perpendicular to the supply line.

2. The method of claim 1 wherein said discharging step includes limiting the spray pattern spread along the minor width (W2) to less than 66% of the major length (L2).

3. The method of claim 1 wherein said discharging step includes limiting the spray pattern spread along the minor width (W2) to less than 33% of the major length (L2).

4. The method of claim 1 wherein said discharging step includes limiting the spray pattern spread along the minor width (W2) to approximately 5-6 feet while concurrently allowing the major length (L2) to spread at least 20 feet.

5. The method of claim 1 wherein said step of locating the supply line includes placing the supply line generally equidistant from each structural support member.

6. The method of claim 1 wherein the sprinkler is an upright sprinkler and said discharging step includes spraying the liquid fire suppressing substance from above the supply line.

7. The method of claim 1 wherein the sprinkler is a pendant sprinkler and said discharging step includes spraying the liquid fire suppressing substance from below the supply line.

8. The method of claim 1 wherein the sprinkler is a horizontal sprinkler and said discharging step includes spraying the liquid fire suppressing substance generally horizontally from the supply line.

9. The method of claim 8, wherein the sprinkler comprises two horizontal sprinklers connected back-to-back to the supply line.

10. The method of claim 1 wherein said securing step includes locating the supply line generally parallel to the structural support members.

11. The method of claim 1 wherein said discharging step includes conforming the liquid fire suppressing substance from each sprinkler to a generally elliptical spray pattern.

12. The method of claim 1 wherein said discharging step includes locating the sprinklers along the supply line so that the spray patterns of adjacent sprinklers overlap.

* * * * *